US005217348A

United States Patent [19]

Rup, Jr. et al.

[11] Patent Number: 5,217,348

[45] Date of Patent: Jun. 8, 1993

[54] TURBINE VANE ASSEMBLY WITH INTEGRALLY CAST COOLING FLUID NOZZLE

[75] Inventors: John J. Rup, Jr., Willington; John P. Nikkanen, West Hartford, both of Conn.

[73] Assignee: United Technologies Corporation, Hartford, Conn.

[21] Appl. No.: 949,968

[22] Filed: Sep. 24, 1992

[51] Int. Cl.[5] ..... F04D 29/58

[52] U.S. Cl. ..... 415/115; 415/116

[58] Field of Search ..... 415/115, 116

[56] References Cited

U.S. PATENT DOCUMENTS

| | | | |
|---|---|---|---|
| 3,135,215 | 6/1964 | Smith | 103/87 |
| 4,265,590 | 5/1981 | Davies | 415/110 |
| 4,332,133 | 6/1982 | Schwarz et al. | 415/116 |
| 4,553,901 | 11/1985 | Laurello | 415/138 |
| 4,627,233 | 12/1986 | Baran, Jr. | 60/39.161 |
| 4,645,424 | 2/1987 | Peters | 416/198 |
| 4,659,285 | 4/1987 | Kalogeros et al. | 416/95 |
| 4,659,289 | 4/1987 | Kalogeros | 416/198 |
| 4,752,185 | 6/1988 | Butler et al. | 415/175 |
| 4,846,628 | 7/1989 | Antonellis | 416/220 R |
| 4,869,640 | 9/1989 | Schwarz et al. | 415/115 |

*Primary Examiner*—John T. Kwon

[57] ABSTRACT

A gas turbine engine having a turbine vane assembly including an integrally cast cooling fluid nozzle is disclosed. Various construction details are developed which disclose a cooling fluid nozzle including a flow passage having an exit and a wall. In one embodiment, the wall includes an angled leading edge which mates with a circumferentially adjacent trailing edge of an adjacent wall. The leading edge is tapered such that in a most open position of the turbine vane assembly the leading edge and the trailing edge circumferentially align. In a most closed position of the turbine vane assembly, the angled leading edge aligns with the trailing edge such that a step down is created in the circumferentially directed flow of the sealed cavity. The plurality of wall thereby produce a waterfall arrangement within the sealed cavity to reduce the windage losses.

6 Claims, 3 Drawing Sheets

TURBINE VANE ASSEMBLY WITH INTEGRALLY CAST COOLING FLUID NOZZLE

TECHNICAL FIELD

This invention relates to gas turbine engines and, more particularly, to turbine vane assemblies.

BACKGROUND ART

A typical gas turbine engine has a compressor section, a combustion section and a turbine section. The gas turbine engine includes an annular flowpath for conducting working fluid sequentially through the compressor, combustor, and turbine sections. The compressor section adds momentum to the working fluid. Fuel is then added to the compressed working fluid in the combustion section. The mixture of fuel and working fluid is burned in a combustion process which adds energy to the working fluid. The hot working fluid is then expanded through the turbine section and energy is transferred from the working fluid to the turbine section. A rotating shaft connects the turbine section to the compressor section. In this way a portion of the energy which is transferred from the working fluid to the turbine section is used to compress incoming working fluid in the compressor.

The turbine section includes a rotor assembly and a stator assembly positioned upstream of the rotor assembly. The rotor assembly includes an array of rotor blades attached to a rotatable disk. Interaction between the working fluid and rotor blades transfers energy to the disk. The stator assembly includes an array of non-rotating vanes. The vanes orient the flow of working fluid to optimize the interaction between the working fluid and rotor blades for maximum efficiency. The optimum orientation of the working fluid is dependent on the flow characteristics of the turbine section and thereby on the thrust requirements of the gas turbine engine.

Many gas turbine engine manufacturers are producing core engines that may be modified to operate in a variety of thrust regimes. A thrust regime is defined as the operating thrust range of a specific application of the gas turbine engine. This procedure reduces cost by eliminating the need to design and manufacture a core engine for each application. For a given gas turbine engine core to operate efficiently in significantly different thrust regimes typically requires the vanes to be altered. One method is to remove and replace the stator assembly with a new stator assembly designed for the specific thrust requirement. Another more economical method is to restagger the existing vanes. Restaggering the vanes is defined as rotating the vanes about their radial axis to a more open or closed position.

The thrust of the gas turbine engine depends in part upon the energy added during the combustion process. The combustion process raises the temperature of the working fluid in proportion to the energy added. The temperature of the working fluid within the turbine section, and thereby the amount of energy which can be added by the combustion process, is limited by the temperature characteristics of the materials used in the turbine section. During operation, rotational forces introduce significant stresses on rotating structure within the turbine section. Increases in temperature reduce the allowable stress and degrade the structural integrity of turbine materials. Therefore, the turbine section must be maintained within acceptable temperature levels to ensure structural integrity. This is especially critical for the first stages of the turbine section which encounter working fluid having the highest temperature.

A structure of particular importance in the turbine section is the rotating seal between the inner diameter of the stator vane assembly and a seal runner extending axially between rotor assemblies. The rotating seal minimizes the amount of working fluid which bypasses the blades and vanes, and thereby maximizes the interaction between the working fluid and the airfoil portions of the blades and vanes. A typical rotating seal includes a plurality of radially extending knife-edges disposed on the seal runner. The knife-edges engage an annular shroud of abradable material disposed on the radially inner end of the vanes. Control of the temperature adjacent to the rotating seals is necessary to maintain the seal within acceptable stress levels.

As is well known in the prior art, a method of maintaining the first stages of the turbine section within acceptable temperature levels is to install a cooling system in the turbine vanes. One such cooling system comprises means to conduct cooling air into the body of the hollow vanes. Typically compressor bleed air is used as a source of cooling air. In this way cooling is provided to the portion of the vanes which extends through the flowpath. The cooling fluid is exhausted through the radially inner portion of the stator vane. A seal cavity, disposed radially inward of the vanes, receives the flow of cooling air form the vanes. The cooling fluid then cools the rotating seals and other structure local to the seal cavity. A drawback to all such cooling systems is the reduced efficiency of the turbine engine as a result of the diversion of working fluid from the compressor section.

Cooling systems for vanes and seal cavities have been the focus of much gas turbine research and development. A major focus has been on using the cooling fluid within the seal cavity as efficiently as possible, thereby minimizing the amount of cooling fluid required. Minimizing the cooling fluid taken from the compressor section increases the efficiency of the gas turbine engine.

Aerodynamics of the seal cavity is a concern because local structure may cause windage losses. Rotating flow surfaces of the rotor assembly produce a circumferentially flowing, annular body of fluid within the cavity. Windage losses are the result of the interaction between circumferentially non-continuous flow surfaces an the radially rotating annulus of fluid within the seal cavity. Windage losses generate heat and result in a loss of efficiency for the cooling system and, consequently, the gas turbine engine. U.S. Pat. No. 4,846,628, issued to Antonellis and entitled "Rotor Assembly for a Turbomachine", is an example of structure which reduces windage losses within the seal cavity. Antonellis discloses a sideplate which is releasably secured to a rotor assembly and has a smooth annular flow surface. The smooth annular flow surface reduces discontinuities within the seal cavity and results in reduced windage losses.

Restaggering the vanes to meet increased thrust requirements may result in an adverse impact on windage losses within the seal cavity. An increase in windage losses in combination with an increase in working fluid temperature required to produce the additional thrust results in greater amounts of cooling necessary to maintain the temperature of the seal cavity within acceptable limits. As mentioned previously, increasing the cooling flow to the seal cavity reduces the efficiency of the turbine engine.

The above art notwithstanding, scientists and engineers under the direction of Applicants' Assignee are working to develop efficient cooling systems for the first stages of the turbine section of a gas turbine engine.

DISCLOSURE OF THE INVENTION

According to the present invention, a turbine vane assembly for a gas turbine engine includes a cooling fluid nozzle integrally cast into the turbine vane assembly, the nozzle having a smooth and continuous flow passage in fluid communication with a source of cooling fluid and adapted to eject cooling fluid tangentially and radially into a seal cavity.

According further to the present invention, the turbine vane assembly is adapted to permit the turbine vane assembly to be restaggered between an open position and a closed position, and wherein the nozzle includes a wall means having a trailing edge and a circumferentially angled leading edge, wherein each leading edge is adapted to circumferentially align with a trailing edge of an adjacent wall means with the turbine vane assembly in the open position and adapted to form a step down relative to the direction of flow within the sealed cavity with the turbine vane assembly in the closed position.

According further still, the nozzle includes an exit which meters the flow of cooling fluid into the seal cavity, wherein the exit has a machinable flow surface which is adapted to be remachined as necessary to increase the flow area of the exit.

A principal feature of the present invention is the circumferentially angled leading edge of the wall means. Another feature is the cast turbine vane assembly having an airfoil portion, a platform portion and an integrally cast cooling fluid nozzle. A further feature of the present invention is the cooling fluid flow passage which extends from the airfoil portion of the vane to the seal cavity of the gas turbine engine. A still further feature is the exit of the nozzle which meters the cooling fluid flow into the seal cavity.

An advantage of the present invention is the adaptability of the wall means for minimizing windage losses at various restagger angles of the stator vane assemblies as a result of the arrangement of the angled leading edge and the trailing edge of the wall means. The arrangement is such that the plurality of trailing and leading edges are either circumferentially flush or form a cascade for the circumferentially flowing annular body of fluid within the seal cavity. The minimal drag of this arrangement is particularly significant as cooling fluid ejection flow velocity is increased. Another advantage of the present invention is the elimination of the cooling fluid nozzle as a separate and distinct part of the turbine vane assembly and the elimination of a welding step in the fabrication and restaggering of the turbine vane assembly. A further advantage of the present invention is the level of efficiency of the sealed cavity cooling as a result of the minimal flow losses within the nozzle flow passage. A still further advantage of the present invention is the capability to remachine the exit of the nozzle to permit an increase in cooling flow to the seal cavity if necessary.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
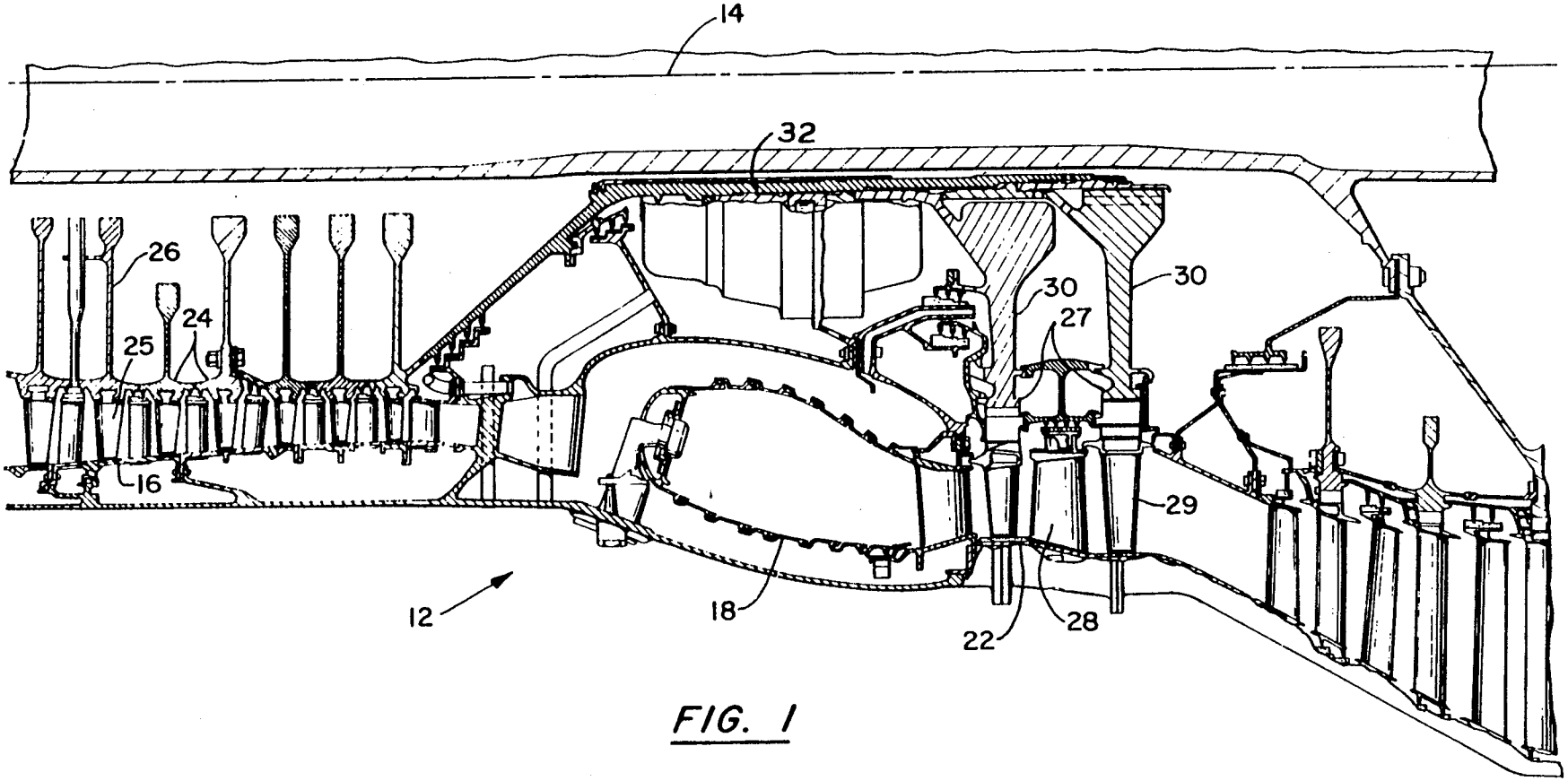
FIG. 1 is a cross-sectional view of a gas turbine engine.

Illustrated in FIG. 1 is a gas turbine engine 12 disposed about a longitudinal axis 14 and including a compressor section 16, a combustion section 18, and a turbine section 22. The compressor section includes a plurality of rotating blade assemblies 24. Each blade assembly includes a plurality of blades 25 disposed on a compressor disk 26. The blade assemblies add energy flowing through the compressor section in form of increased momentum to working fluid. From the compressor section the working fluid enters the combustion section where fuel is added to the compressed working fluid and the combination of working fluid and fuel is combusted. The combustion process adds additional energy to the mixture of working fluid and fuel. The products of combustion then pass through the turbine section which includes a plurality of rotating turbine blade assemblies 27 and non-rotating turbine vane assemblies 28. Each turbine blade assembly includes a plurality of blades 29 disposed on a turbine disk 30. Energy is extracted from the working fluid by the rotating turbine blades. A portion of the extracted energy is returned from the turbine blades to the compression section via a shaft 32 interconnecting the compression section and the turbine section.

The turbine vane assemblies function to condition the flow of working fluid prior to engagement of the working fluid with an adjacent downstream turbine blade assembly. The turbine vane assemblies condition the flow for optimum efficiency of the energy transfer between flowing working fluid and the rotating turbine blades 29. The pitch angle $\gamma$ of the turbine vane assemblies controls the amount and direction of working fluid acting upon the turbine blades. The optimum pitch angle $\gamma$ depends upon the flow characteristics of the gas turbine engine. For a given core gas turbine engine to operate efficiently in significantly different thrust regimes may require the pitch angle $\gamma$ to be changed to accommodate the different flow characteristics. The optimum pitch angle $\gamma$ may be a more open position $\gamma_1$ (see FIG. 4) or a more closed position $\gamma_2$ (see FIG. 5).

Figure 2:
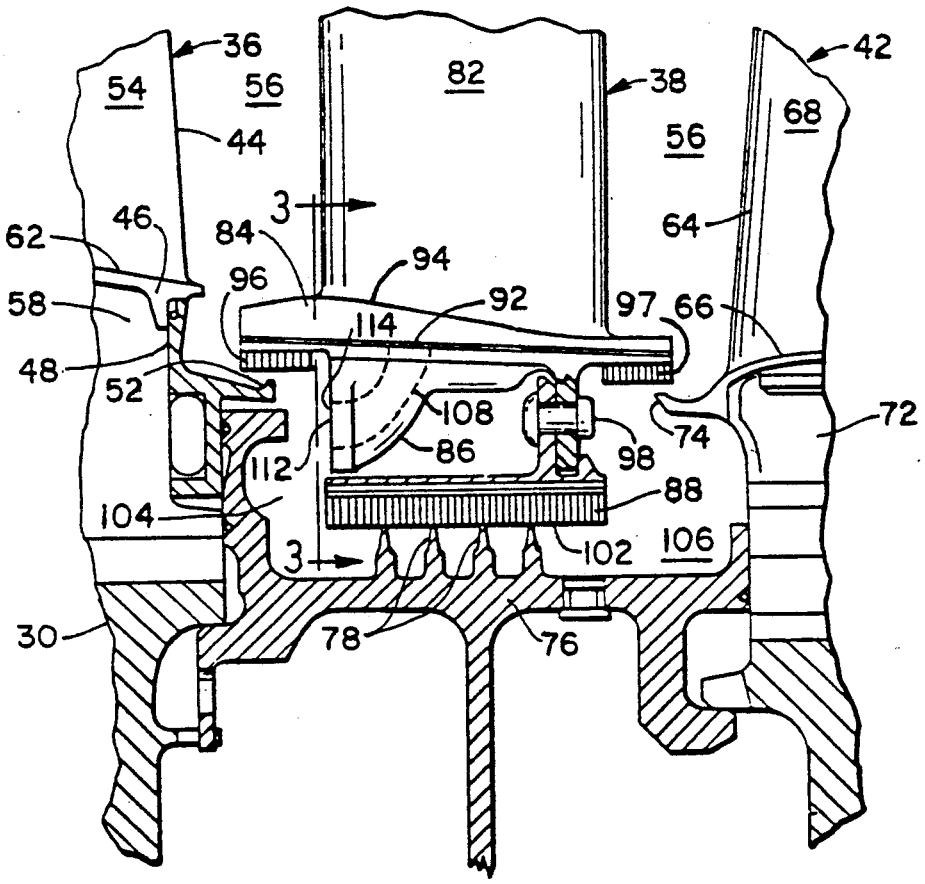
FIG. 2 is a side view of a turbine vane assembly, partially cut away to show a cooling fluid nozzle.

Referring now to FIG. 2, a first stage turbine rotor assembly 36, a turbine vane assembly 38, and a second stage turbine rotor assembly 42 are shown. The first stage turbine rotor assembly includes a plurality of blades 44, a corresponding plurality of platforms 46, and a side plate 48 having a knife-edge seal 52. Each blade includes an airfoil portion 54 which extends into the working fluid flow passage 56 and a root portion 58 attached to the disk 30. The platform provides a radially inner flow surface 62 for the working fluid flow passage. The knife-edge seal extends radially outward from the sideplate and engages the turbine vane assembly. The knife-edge seal provides sealing means between the first stage rotor assembly and the turbine vane assembly to block working fluid from flowing radially inward.

The second stage turbine rotor assembly includes a plurality of blades 64 and platforms 66. Each blade includes an airfoil portion 68 which extends into the working fluid flow passage and a root portion 72 attached to the disk. Each platform has a knife-edge seal 74 disposed on the upstream end of the platform. The knife-edge seal extends radially outward and engages the turbine vane assembly to provide sealing means between the turbine vane assembly and the second stage turbine rotor assembly to block working fluid from flowing radially inward.

A seal runner 76 extends axially between the first stage rotor assembly and the second stage turbine rotor assembly. The seal runner is an annular structure and includes a plurality of knife-edge seals 78 extending radially outward. The knife-edge seals engage the turbine vane assembly to provide sealing means between the first stage turbine rotor assembly and the second stage turbine rotor assembly. This sealing means blocks the axial flow of fluid between the turbine rotor assemblies.

The turbine vane assembly includes a vane 82, a platform 84, a nozzle 86, and a sealing shroud 88. The aerodynamically shaped vane extends across the working fluid flow passage and is attached to a radially outer casing (not shown) of the gas turbine engine. The vane is hollow to allow passage of cooling fluid radially through the vane. Means for conducting cooling fluid (not shown) from the compressor section into the hollow vane is disposed outward of the outer casing. An opening 92 between the vane and the nozzle permits communication between the hollow vane and the nozzles.

The platform 84 provides a radially inner surface 94 for the working fluid flow passage and includes abradable surface 96, which engages the knife-edge seals to provide sealing means. The sealing means provided by the surfaces and the knife-edge seals blocks the working fluid from flowing radially inwardly and out of the flowpath.

The sealing shroud 88 is fastened to the turbine vane assembly by a mechanical fastener 98. The sealing shroud provides a radially inner surface 102 which engages the knife-edge seals of the seal runner. The radially inner surface is an abradable surface which, in conjunction with the knife-edge seals, provides sealing means to block the axial flow of gases between the seal runner and the turbine vane assembly.

A pair of annular cavities are defined by the turbine rotor assemblies and the turbine vane assembly. An upstream seal cavity 104 is defined by the separation between the first stage turbine rotor assembly, the turbine vane assembly, and the seal runner. Knife-edge seal 52 and surface 96 block working fluid from passing from the flowpath into the upstream seal cavity. Knife-edge seals 78 and surface 102 block fluid within the seal cavity from flowing axially downstream. A downstream seal cavity 106 is defined by the separation between the turbine vane assembly, the second stage turbine rotor assembly, and the downstream end of the seal runner. The seal cavity is sealed by the engagement of surfaces 97 with knife-edge seal 74.

The nozzle is integrally cast into the turbine vane assembly and includes a cooling fluid flow passage 108 having an exit 112 and a wall means 114. The cooling fluid flow passage is in fluid communication with the hollow portion of the airfoil and thereby in fluid communication with the source of cooling fluid. Cooling fluid exits the flow passage through the exit and into the upstream seal cavity. The nozzle includes a throat portion 116 which meters the flow exiting the flow passage.

Figure 5:
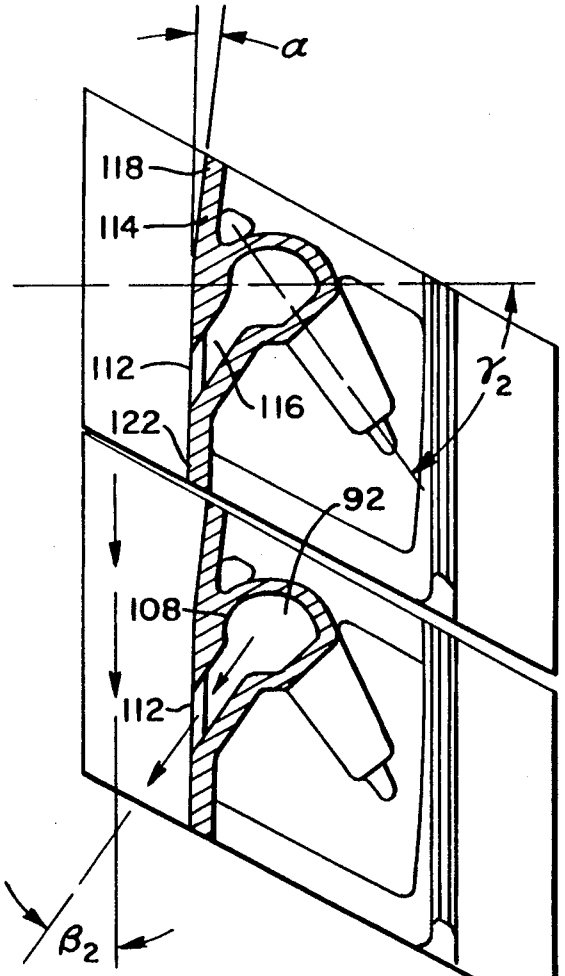
FIG. 5 is a cross-sectional, radially outward view of a cooling fluid nozzle with the vanes in the most closed position.
Figure 4:
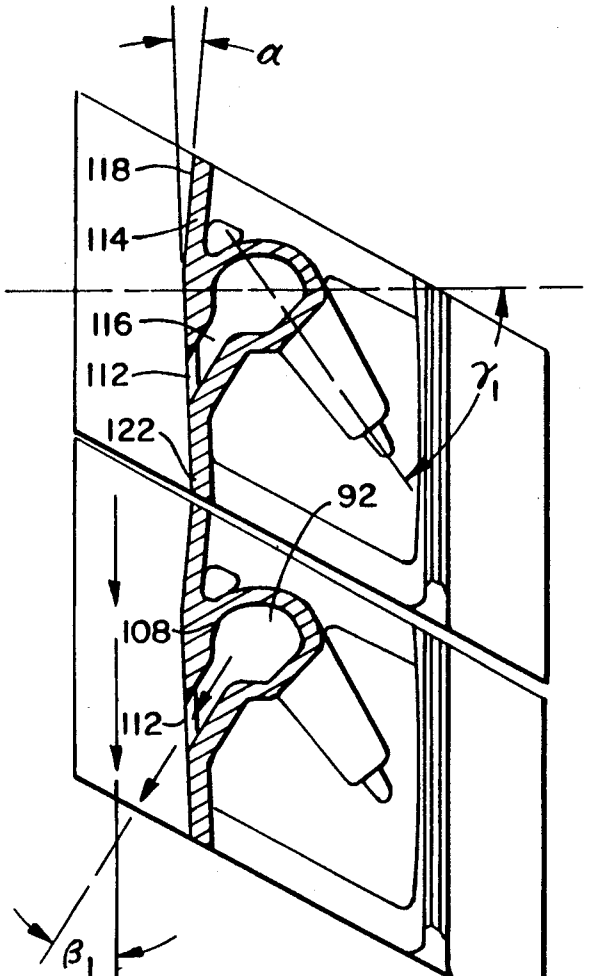
FIG. 4 is a cross-sectional, radially outward view of a cooling flow nozzle with the vanes in the most open position.

The wall means includes a circumferentially angled leading edge 118 and a trailing edge 122. The leading edge is tapered at an angle $\alpha$ as shown in FIGS. 4 and 5. The angle $\alpha$ is dependent upon the maximum amount of rotation about the radial axis of the turbine vane assembly which is required for the core gas turbine engine to operate in the desired thrust ranges. As shown in FIGS. 4 and 5, the arrangement of leading edges and trailing edges is such that with the turbine vane assemblies in a most opened position the axial upstream surface of the wall means line up in the circumferential direction. This permits a smooth transition of the circumferentially directed flow within the seal cavity as the cooling fluid flows from one surface of a wall means to the circumferentially downstream and adjacent surface. With the turbine vane assemblies in the most closed position as shown in FIG. 5, the arrangement of trailing edges to leading edges is such that a step down occurs in the flow over the surfaces of the wall means. The step down produces a waterfall or cascade effect of the cooling fluid flowing within the annular sealed cavity. This waterfall arrangement, rather than a step-up or dam arrangement, results in minimizing windage losses in situations where restaggering precludes a line on line arrangement as shown in FIG. 4. Although apparent to those skilled in the art, it should be noted that restaggering the vane assemblies may require remachining the platforms to permit rotation of adjacent platforms about the radial axis. The angled leading edge precludes the need to machine the wall means, which may be impractical and costly.

During operation, friction from the rotating flow surfaces of the first stage turbine rotor assembly and the seal runner causes the body of fluid within the upstream seal cavity to rotate about the longitudinal axis. The seal cavity becomes a circumferentially flowing annular body of fluid as shown by arrows. The fluid within the seal cavity is comprised of a mixture of cooling fluid from the nozzle and working fluid which leaks around the knife-edge seal. The cooling fluid injected into the seal cavity performs several functions. First, the injection provides fluid to satisfy leakage through the knife-edge seals 78 and the vane assembly. This leakage is caused by the pressure differential between the upstream and downstream cavities. Without the injection of cooling fluid, hot working fluid would be pulled into the seal cavity and through the knife-edge seals, thereby raising the temperature of the rotating seal structure. Second, the injected cooling fluid balances the disk pumping effect of the rotating structure within the seal cavity. The rotating surfaces urge fluid within boundary layers adjacent to the surfaces to flow radially outward into the flowpath. Without cooling fluid to counterbalance this, hot working fluid would be drawn into the seal cavity. The injection of cooling fluid minimizes, and may prevent, the ingestion of hot working fluid into the seal cavity. Third, the cooling fluid, since it is at a lower temperature than the working fluid, cools local structure within the seal cavity and downstream of the knife-edge seals 78 as it flows over this structure. Cooling is necessary to maintain the structural integrity of highly stressed, rotating structure and to maintain proper operation of the sealing means. Diverting compressed air from the compressor section, or providing an external source of cooling air, to provide cooling in the turbine section reduces overall engine efficiency. Therefore it is beneficial to efficiently use the cooling fluid.

Figure 3:
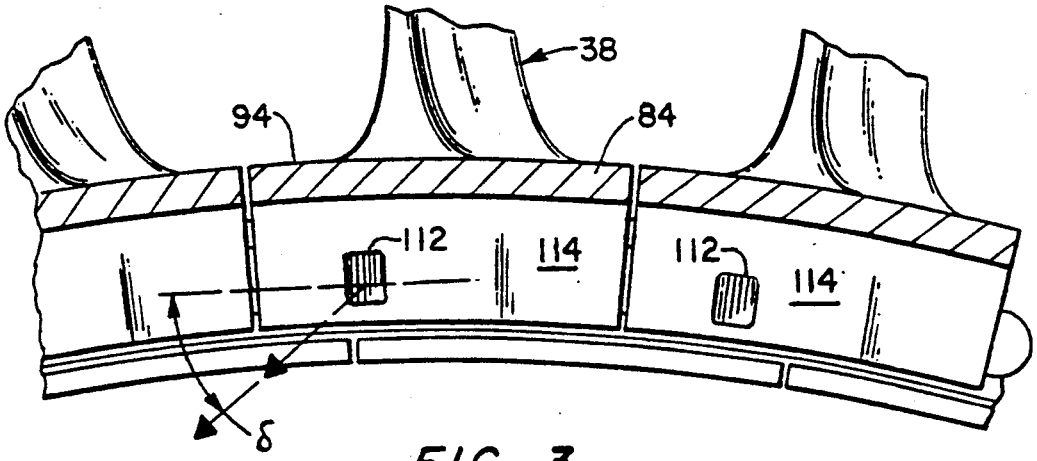
FIG. 3 is a view taken along a longitudinal axis of the gas turbine engine, which illustrates the turbine vane assembly including the wall means and exit.

Cooling fluid enters the hollow portion of the airfoil and passes into the cooling fluid flow passage of the nozzle. The transition from the hollow cavity of the airfoil portion to the cooling fluid flow passage is smooth and continuous to prevent pressure losses within the passages. The cooling fluid exits the nozzle through the exit where the flow of cooling fluid is metered by the throat portion of the exit. The throat portion is sized for specific engine requirements. The simple rectangular exit nozzle and throat portion permits the nozzle to be easily changed to increase cooling flow as necessary. The throat portion may be opened up using conventional tooling methods and apparatus. The cooling fluid is ejected from the nozzle at an angle $\beta$ relative to the lateral direction and at an angle $\delta$ (see FIG. 3) relative to the circumferential direction. The angle $\beta$ is as small as possible, within conventional casting and machining constraints, in order to maintain the fluid flowing out of the nozzle at an angle which is substantially tangential to the flow of cooling fluid within the sealed cavity. Maintaining a substantially tangentially directed flow exiting the nozzle reduces the amount of work the circumferentially directed flow must do on the injected fluid to redirect it into the circumferential direction. This reduces the heat up of the cooling fluid within the sealed cavity and thereby increases the effectiveness of the cooling system. The cooling fluid is injected at the angle $\delta$ to reduce the size of the change in direction of the flow between the hollow cavity and the ejection direction. This feature minimizes flow losses associated with sharp and abrupt changes in direction. In addition, injecting cooling fluid at an angle $\delta$ directs a portion of the cooling flow into the radially inner and axially forward section of the sealed cavity. This section of the sealed cavity requires increased cooling due to the higher temperatures in the region and the highly stressed structure in that region.

Although this invention has been shown and described with respect to detailed embodiments thereof, it will be understood by those skilled in the art that various changes in form and detail thereof may be made without departing from the spirit and scope of the claimed invention.

We claim:

1. A gas turbine engine disposed about a longitudinal axis and including an axially extending flow path, a turbine section, and means to conduct cooling fluid into the turbine section, the turbine section including a rotor assembly disposed circumferentially about the axis, sealing means disposed axially downstream of the rotor assembly, the rotor assembly and sealing means adapted to rotate about the axis in an operational condition, and a turbine vane assembly disposed axially downstream of the rotor assembly and radially outward of the sealing means, wherein an annular seal cavity is defined in part by the separation between the rotor assembly, the turbine vane assembly and the sealing means, the turbine vane assembly including a plurality of vanes, and a sealing shroud adapted to engage the sealing means to block the passage of fluid from the cavity, wherein each vane has a pitch angle $\gamma$ with $\gamma \geqq \gamma_1$ wherein $\gamma_1$ is the most open pitch angle, each vane including an airfoil portion, a platform, and an integrally cast nozzle, the airfoil portion being hollow and in fluid communication with the means to conduct cooling fluid, the nozzle including wall means having a flow surface facing the cavity, and a smooth, continuous flow passage in fluid communication with the airfoil portion and adapted to direct cooling fluid into the cavity, the wall means extending circumferentially between adjacent wall means and extending radially inward from the platform, each wall means having a trailing edge and a leading edge, the leading edge adapted to circumferentially align with the trailing edge of an adjacent wall means with $\gamma = \gamma_1$, and the leading edge adapted to form a step down relative to the direction of flow within the cavity with $\gamma > \gamma_1$.

2. The gas turbine engine according to claim 1, wherein the nozzle is adapted to direct cooling fluid into an axially forward, radially inward portion of the cavity.

3. The gas turbine engine according to claim 1, wherein the nozzle further includes a throat portion adapted to meter the cooling fluid entering the cavity.

4. A turbine vane assembly for a turbomachine disposed about a longitudinal axis and including an axially extending flow path, a turbine section, and means to conduct cooling fluid into the turbine section, the turbine section including a rotor assembly disposed circumferentially about the axis, sealing means disposed axially downstream of the rotor assembly, the rotor assembly and sealing means adapted to rotate about the axis in an operational condition, and a turbine vane assembly disposed axially downstream of the rotor assembly and radially outward of the sealing means, wherein an annular seal cavity is defined in part by the separation between the rotor assembly, the turbine vane assembly and the sealing means, the seal cavity having effectively continuous flow surfaces, the turbine vane assembly including a plurality of vanes and a sealing shroud adapted to engage the sealing means to block the passage of fluid from the cavity, wherein each vane has a pitch angle $\gamma$ with $\gamma \geqq \gamma_1$ wherein $\gamma_1$ is the most open pitch angle, each vane including an airfoil portion, a platform, and an integrally cast nozzle, the airfoil portion being hollow and in fluid communication with the means to conduct cooling fluid, the nozzle including wall means having a flow surface facing the cavity, and a smooth, continuous flow passage in fluid communication with the airfoil portion and adapted to direct cooling fluid into the cavity, the wall means extending circumferentially between adjacent wall means and extending radially inward from the platform, each wall means having a trailing edge and a leading edge, the leading edge adapted to circumferentially align with the trailing edge of an adjacent wall means with $\gamma = \gamma_1$, and the leading edge adapted to form a step down relative to the direction of flow within the cavity with $\gamma > \gamma_1$.

5. The turbine vane assembly according to claim 4, wherein the nozzle is adapted to inject cooling fluid in a tangential direction relative to the flow within the seal cavity and to direct cooling fluid into an axially forward, radially inward portion of the cavity.

6. The turbine vane assembly according to claim 4, wherein the nozzle further includes a throat portion adapted to meter the cooling fluid entering the cavity.

* * * * *